US012715674B2

(12) United States Patent
Popwell et al.

(10) Patent No.: US 12,715,674 B2
(45) Date of Patent: Aug. 25, 2026

(54) CONTACT LENS PACKAGES HAVING AN ABSORBENT MEMBER

(71) Applicant: Johnson & Johnson Vision Care, Inc., Jacksonville, FL (US)

(72) Inventors: Sam Jonathan Popwell, Jacksonville, FL (US); Daniel Graham Ward, Bishop'Stortford (GB); Stephen Sams, Bassingbourn (GB); Ismail Akram, Cambridge (GB)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 0 days.

(21) Appl. No.: 18/785,142

(22) Filed: Jul. 26, 2024

(65) Prior Publication Data

US 2024/0425263 A1 Dec. 26, 2024

Related U.S. Application Data

(63) Continuation of application No. 18/154,482, filed on Jan. 13, 2023, now Pat. No. 12,187,522.

(51) Int. Cl.

| | |
|---|---|
| ***B65D 81/26*** | (2006.01) |
| ***B65D 75/32*** | (2006.01) |
| ***B65D 85/38*** | (2006.01) |

(52) U.S. Cl.

CPC ..... *B65D 81/264* (2013.01); *B65D 75/326* (2013.01); *B65D 85/38* (2013.01); *B65D 2585/545* (2013.01)

(58) Field of Classification Search

CPC .... B65D 81/264; B65D 75/326; B65D 85/38; B65D 2585/545; B65D 75/327; A45C 11/046; A45C 11/005

USPC ..... 206/5.1

See application file for complete search history.

(56) References Cited

U.S. PATENT DOCUMENTS

| | | | |
|---|---|---|---|
| 1,092,075 | A | 3/1914 | Monberg |
| 3,088,830 | A | 5/1963 | Graham |
| 3,089,500 | A | 5/1963 | Stalcup |
| 3,159,308 | A | 12/1964 | Lawrence |

(Continued)

FOREIGN PATENT DOCUMENTS

| | | | |
|---|---|---|---|
| BR | 202016013147 | | 4/2019 |
| CN | 2835140 | Y | 11/2006 |

(Continued)

OTHER PUBLICATIONS

International Search Report and Written Opinion for International Application No. PCT/IB2023/060285, mailed Jan. 17, 2024, 10 Pages.

(Continued)

*Primary Examiner* — Rafael A Ortiz

(74) *Attorney, Agent, or Firm* — Casimir Jones, S.C.; Thomas J. Lyneis

(57) ABSTRACT

The present invention relates to improved contact lens packages and methods of use and manufacture/assembly. A contact lens package may include a cavity that houses a contact lens, packaging solution, and an absorbent member. In one aspect, the absorbent member may be configured for transitioning between an expanded state and a compressed state, and the absorbent member may be in the compressed state when the package is in an unopened state.

38 Claims, 2 Drawing Sheets

(56) References Cited

U.S. PATENT DOCUMENTS 3,369,656 A 2/1968 Skinner
3,414,117 A 12/1968 Leeds
3,473,886 A 10/1969 Leeds
3,490,806 A 1/1970 Lopez-Calleja
3,524,455 A 8/1970 Hoogesteger
3,584,908 A 6/1971 Ray
3,977,517 A 8/1976 Kadlecik et al.
4,187,574 A 2/1980 Wrue
4,392,569 A 7/1983 Shoup
4,415,076 A 11/1983 Campbell
4,444,307 A 4/1984 Jermyn
4,495,313 A 1/1985 Larsen
4,512,601 A 4/1985 Jacobstein
4,659,782 A 4/1987 Spinelli
4,659,783 A 4/1987 Spinelli
4,691,820 A 9/1987 Martinez
4,751,950 A 6/1988 Bock
4,889,664 A 12/1989 Kindt-Larsen et al.
4,942,959 A 7/1990 Sauber
4,986,414 A 1/1991 Ashley et al.
5,031,622 A 7/1991 Lahaye
5,039,459 A 8/1991 Kindt-Larsen et al.
5,053,208 A 10/1991 Seamons
5,099,987 A 3/1992 Bieri
5,227,039 A 7/1993 Pankow
5,244,981 A 9/1993 Seidner et al.
5,314,960 A 5/1994 Spinelli
5,331,067 A 7/1994 Seidner et al.
5,371,147 A 12/1994 Spinelli
5,375,698 A 12/1994 Eward et al.
5,407,062 A 4/1995 Shannon
5,415,275 A 5/1995 Girimont
5,452,027 A 9/1995 Tylec
5,467,868 A 11/1995 Abrams et al.
5,474,169 A 12/1995 Bauman
5,494,528 A * 2/1996 Beckrich ..... G02C 13/008 15/104.93
5,515,964 A 5/1996 Bauman
5,609,246 A 3/1997 Borghorst et al.
5,620,088 A 4/1997 Martin
5,690,226 A 11/1997 N'guyen
5,695,049 A 12/1997 Bauman
5,704,468 A 1/1998 Lust et al.
5,711,416 A 1/1998 Bauman
5,722,536 A 3/1998 Pierce
5,732,990 A 3/1998 Yavitz
5,760,100 A 6/1998 Nicolson et al.
5,776,999 A 7/1998 Nicolson et al.
5,789,461 A 8/1998 Nicolson et al.
5,846,196 A 12/1998 Siekmeyer et al.
5,849,811 A 12/1998 Nicolson et al.
5,853,085 A 12/1998 Luttrell
5,908,133 A 6/1999 Luburic et al.
5,965,631 A 10/1999 Nicolson et al.
5,998,498 A 12/1999 Vanderlaan
6,010,001 A 1/2000 Osborn, III
6,029,808 A 2/2000 Peck et al.
6,087,415 A 7/2000 Vanderlaan
6,138,212 A 10/2000 Cummings
6,138,312 A * 10/2000 Cummings ..... A61L 12/086 15/104.93
6,253,912 B1 7/2001 ONeill
6,260,695 B1 7/2001 Tasber
6,276,797 B1 8/2001 Shannon
6,280,530 B1 8/2001 Pankow
6,286,666 B1 9/2001 Umdasch
6,289,907 B1 9/2001 Horian et al.
RE37,558 E 2/2002 Abrams
6,367,929 B1 4/2002 Maiden et al.
6,401,915 B1 6/2002 Faxe
6,572,165 B2 6/2003 Faxe
6,822,016 B2 11/2004 McCabe et al.
6,867,245 B2 3/2005 Iwata et al.
6,943,203 B2 9/2005 Vanderlaan
7,086,526 B2 8/2006 Newman
7,225,919 B2 6/2007 Hamilton
7,247,692 B2 7/2007 Laredo
7,249,848 B2 7/2007 Laredo
7,275,275 B2 10/2007 Pankow
7,398,877 B1 7/2008 Nelson
7,410,050 B2 8/2008 Py
7,426,993 B2 9/2008 Coldrey
7,441,650 B2 10/2008 Tanaka
7,461,740 B2 12/2008 Newman
7,540,376 B2 6/2009 Mahieu
7,553,880 B2 6/2009 Nicolson et al.
7,666,921 B2 2/2010 McCabe et al.
7,786,185 B2 8/2010 Rathore
7,819,241 B2 10/2010 Post-Smith
7,832,551 B2 11/2010 Newman
7,832,552 B2 11/2010 Newman
7,850,002 B2 12/2010 Newman
7,938,255 B2 5/2011 Newman
7,956,131 B2 6/2011 Arnold
8,022,158 B2 9/2011 Rathore
8,104,608 B2 1/2012 Newman
D658,077 S 4/2012 Newman
8,251,205 B2 8/2012 Azera
8,273,802 B2 9/2012 Laredo
8,399,538 B2 3/2013 Steffan
8,450,387 B2 5/2013 Mccabe et al.
8,470,906 B2 6/2013 Rathore
8,487,058 B2 7/2013 Liu
8,507,577 B2 8/2013 Zanini
D690,207 S 9/2013 Newman
8,637,621 B2 1/2014 Iwata et al.
8,703,891 B2 4/2014 Broad
8,833,548 B2 9/2014 Hsieh
8,881,892 B1 11/2014 Linhardt
8,937,110 B2 1/2015 Alli
8,937,111 B2 1/2015 Alli
8,940,812 B2 1/2015 Reboul
9,044,075 B2 6/2015 Linhardt
9,056,878 B2 6/2015 Fujisawa
9,057,821 B2 6/2015 Broad
9,067,720 B2 6/2015 Howell
9,095,195 B2 8/2015 Mori
9,125,808 B2 9/2015 Alli
9,140,825 B2 9/2015 Alli
9,156,934 B2 10/2015 Alli
9,170,349 B2 10/2015 Mahadevan
9,206,544 B2 12/2015 Zeng
9,244,196 B2 1/2016 Scales
9,244,197 B2 1/2016 Alli
9,260,544 B2 2/2016 Rathore et al.
9,297,928 B2 3/2016 Molock
9,297,929 B2 3/2016 Scales
9,320,566 B1 4/2016 Alston et al.
9,358,736 B2 6/2016 Wang
9,576,609 B2 2/2017 Huang
9,668,558 B2 6/2017 Clamp
9,701,458 B2 7/2017 Barrows
D804,323 S 12/2017 Harrison
D805,920 S 12/2017 Clamp
9,839,270 B2 12/2017 Howell
D813,537 S 3/2018 Miura
10,092,075 B2 10/2018 Barre
10,138,042 B2 11/2018 Fawdington
10,194,724 B2 2/2019 Newman
10,364,082 B2 7/2019 Coon
10,368,621 B2 8/2019 Barre
10,463,127 B2 11/2019 Kim
10,577,166 B2 3/2020 Barrows
10,661,964 B2 5/2020 Tokarski
D899,080 S 10/2020 Yasuda
D899,081 S 10/2020 Yamamoto
10,901,236 B2 1/2021 Schweizer
10,926,944 B2 2/2021 Huang
11,071,644 B2 7/2021 Greenwood
11,077,969 B2 8/2021 Newman
11,136,176 B2 10/2021 Almond
11,229,266 B2 1/2022 Almond et al.
11,485,557 B2 11/2022 Swamy
11,628,998 B2 4/2023 Ho

(56) References Cited

U.S. PATENT DOCUMENTS

| | | | | |
|---|---|---|---|---|
| 11,649,099 | B2 | 5/2023 | Ellis | |
| 11,684,131 | B2 * | 6/2023 | Almond | B65D 75/366 206/5.1 |
| 11,751,654 | B2 * | 9/2023 | Lansing | B65D 85/54 206/5.1 |
| 12,064,018 | B2 | 8/2024 | Popwell et al. | |
| 12,303,190 | B2 | 5/2025 | Govari et al. | |
| 12,304,707 | B2 | 5/2025 | Hoefte et al. | |
| 12,357,068 | B2 | 7/2025 | Sullivan et al. | |
| 2001/0017271 | A1 * | 8/2001 | Yavitz | G02C 13/008 206/207 |
| 2002/0158477 | A1 | 10/2002 | Faxe | |
| 2002/0163212 | A1 | 11/2002 | Py | |
| 2004/0134005 | A1 | 7/2004 | Pankow | |
| 2004/0238380 | A1 | 12/2004 | Newman | |
| 2005/0087453 | A1 | 4/2005 | Mahieu et al. | |
| 2005/0103649 | A1 | 5/2005 | Vulcu et al. | |
| 2005/0218012 | A1 | 10/2005 | Tanaka et al. | |
| 2006/0054514 | A1 | 3/2006 | Tokarski et al. | |
| 2006/0151584 | A1 | 7/2006 | Wonnacott | |
| 2006/0201103 | A1 | 9/2006 | Tokarski et al. | |
| 2006/0213783 | A1 | 9/2006 | Tokarski | |
| 2006/0213784 | A1 | 9/2006 | Tokarski et al. | |
| 2006/0219577 | A1 | 10/2006 | Newman | |
| 2006/0260956 | A1 | 11/2006 | Stachowski | |
| 2006/0260957 | A1 | 11/2006 | Hamilton | |
| 2007/0000792 | A1 | 1/2007 | Newman et al. | |
| 2007/0164576 | A1 | 7/2007 | Kim | |
| 2008/0011619 | A1 | 1/2008 | Newman | |
| 2008/0047848 | A1 | 2/2008 | Tokarski et al. | |
| 2008/0078681 | A1 * | 4/2008 | Newman | B65D 73/005 29/428 |
| 2008/0170201 | A1 | 7/2008 | Filippo | |
| 2008/0307751 | A1 | 12/2008 | Newman et al. | |
| 2009/0121370 | A1 | 5/2009 | Barrows | |
| 2009/0139879 | A1 | 6/2009 | Tokarski | |
| 2009/0200182 | A1 | 8/2009 | Post-Smith | |
| 2010/0048847 | A1 | 2/2010 | Broad | |
| 2010/0072082 | A1 | 3/2010 | Kang | |
| 2010/0187140 | A1 | 7/2010 | Tokarski et al. | |
| 2011/0017243 | A1 | 1/2011 | Voss | |
| 2012/0267262 | A1 | 10/2012 | Wang | |
| 2013/0091613 | A1 | 4/2013 | Meltzner | |
| 2013/0277242 | A1 | 10/2013 | Mori | |
| 2014/0001059 | A1 | 1/2014 | Hsieh et al. | |
| 2014/0027462 | A1 | 1/2014 | Willat | |
| 2014/0027465 | A1 | 1/2014 | Howell et al. | |
| 2014/0246337 | A1 | 9/2014 | Newman | |
| 2014/0262844 | A1 | 9/2014 | Barre et al. | |
| 2015/0014187 | A1 | 1/2015 | Gilman | |
| 2015/0041346 | A1 | 2/2015 | Seyfferth De Oliveira | |
| 2015/0150346 | A1 | 6/2015 | Yasuda | |
| 2015/0173474 | A1 | 6/2015 | Barrows | |
| 2016/0198825 | A1 | 7/2016 | Fawdington | |
| 2016/0309962 | A1 | 10/2016 | Hanson et al. | |
| 2017/0006984 | A1 | 1/2017 | Sheardown et al. | |
| 2017/0172269 | A1 | 6/2017 | Lin | |
| 2018/0134475 | A1 | 5/2018 | Newman et al. | |
| 2018/0340622 | A1 | 11/2018 | Godfrey | |
| 2019/0046353 | A1 | 2/2019 | Greenwood et al. | |
| 2019/0133275 | A1 | 5/2019 | Newman | |
| 2019/0263580 | A1 | 8/2019 | Pickard et al. | |
| 2019/0322417 | A1 | 10/2019 | Hurt et al. | |
| 2020/0229560 | A1 | 7/2020 | Almond et al. | |
| 2020/0229561 | A1 | 7/2020 | Almond et al. | |
| 2020/0229562 | A1 | 7/2020 | Almond et al. | |
| 2020/0229563 | A1 | 7/2020 | Almond et al. | |
| 2020/0231351 | A1 | 7/2020 | Almond et al. | |
| 2020/0383440 | A1 | 12/2020 | Newman | |
| 2021/0018661 | A1 | 1/2021 | Swamy et al. | |
| 2021/0139229 | A1 | 5/2021 | Huang | |
| 2022/0133007 | A1 | 5/2022 | Almond et al. | |
| 2022/0330671 | A1 | 10/2022 | Bruchon | |
| 2022/0365368 | A1 | 11/2022 | Greenwood et al. | |
| 2023/0083028 | A1 | 3/2023 | Popwell | |
| 2023/0276917 | A1 | 9/2023 | Popwell | |
| 2024/0099434 | A1 | 3/2024 | Popwell et al. | |
| 2024/0122321 | A1 | 4/2024 | Popwell et al. | |
| 2024/0239586 | A1 | 7/2024 | Popwell et al. | |
| 2025/0058951 | A1 | 2/2025 | Popwell et al. | |
| 2025/0261892 | A1 | 8/2025 | Sterrett et al. | |

FOREIGN PATENT DOCUMENTS

| | | | |
|---|---|---|---|
| CN | 101254872 | A | 9/2008 |
| CN | 101662967 | | 3/2010 |
| CN | 211418131 | U | 9/2020 |
| CN | 111759065 | | 10/2020 |
| DE | 4415003 | | 6/1995 |
| DE | 202006004323 | | 5/2006 |
| EP | 0269367 | | 6/1988 |
| EP | 0887283 | A1 | 12/1998 |
| EP | 3045071 | | 7/2016 |
| EP | 2768465 | B1 | 9/2019 |
| FR | 2712398 | | 5/1995 |
| FR | 2777360 | | 10/1999 |
| GB | 2551530 | | 12/2017 |
| JP | H01279222 | | 11/1989 |
| JP | H10313928 | | 12/1998 |
| JP | 2001046134 | | 2/2001 |
| JP | 2004105563 | A | 4/2004 |
| JP | 2009057097 | A | 3/2009 |
| JP | 2012149050 | A | 8/2012 |
| JP | 5184925 | | 1/2013 |
| JP | 2014218255 | | 11/2014 |
| JP | 6004912 | B2 | 10/2016 |
| JP | 2016179837 | A | 10/2016 |
| JP | 6129238 | | 4/2017 |
| JP | 6129239 | | 4/2017 |
| JP | 6339322 | B2 | 5/2018 |
| KR | 100768522 | | 10/2007 |
| KR | 20080066930 | | 7/2008 |
| KR | 20080090252 | | 10/2008 |
| KR | 20090060075 | | 6/2009 |
| KR | 20100002433 | A | 1/2010 |
| KR | 101495874 | | 2/2015 |
| KR | 20160064382 | | 6/2016 |
| KR | 20190003113 | | 12/2019 |
| KR | 200490803 | | 2/2020 |
| NL | 2000268 | | 4/2008 |
| TW | 200930318 | | 7/2009 |
| TW | D159617 | | 4/2014 |
| TW | 479048 | | 6/2014 |
| TW | D172590 | | 12/2015 |
| WO | WO 99/21519 | | 5/1999 |
| WO | WO 2002088780 | | 11/2002 |
| WO | WO 03022321 | | 3/2003 |
| WO | WO 2005/006062 | | 1/2005 |
| WO | WO 2005/055760 | | 6/2005 |
| WO | WO 2005073105 | | 8/2005 |
| WO | WO 2005/082721 | | 9/2005 |
| WO | 2006032829 | A1 | 3/2006 |
| WO | WO 2006068583 | | 6/2006 |
| WO | WO 2006105179 | | 10/2006 |
| WO | WO 2008061992 | | 5/2008 |
| WO | WO 2008120954 | | 10/2008 |
| WO | WO 2009/059231 | | 5/2009 |
| WO | WO 2009069265 | | 6/2009 |
| WO | WO 2012165209 | | 12/2012 |
| WO | WO 2012168964 | | 12/2012 |
| WO | WO 2013058712 | | 4/2013 |
| WO | WO 2013/134547 | | 9/2013 |
| WO | WO 2013/136361 | | 9/2013 |
| WO | WO 2013/153582 | | 10/2013 |
| WO | WO 2014185354 | | 11/2014 |
| WO | WO 2014195588 | | 12/2014 |
| WO | WO 2015150704 | | 10/2015 |
| WO | WO 2017/137738 | | 8/2017 |
| WO | WO 2019013199 | | 1/2019 |
| WO | WO 2020/152444 | | 7/2020 |
| WO | WO 2020/152446 | | 7/2020 |
| WO | WO 2021176760 | | 9/2021 |
| WO | WO 2021/260353 | | 12/2021 |
| WO | WO 2022/054033 | | 3/2022 |

(56) References Cited

FOREIGN PATENT DOCUMENTS

| | | |
|---|---|---|
| WO | WO 2022054031 | 3/2022 |
| WO | WO 2022123525 | 6/2022 |
| WO | 2024084347 | 4/2024 |

OTHER PUBLICATIONS

International Search Report for International Application No. PCT/IB2023/059481, mailed Dec. 18, 2023, 7 Pages.
International Search Report for International Application No. PCT/IB2024/050248, mailed Mar. 11, 2024, 6 Pages.
Written Opinion for International Application No. PCT/IB2024/050248, mailed Mar. 11, 2024, 5 Pages.
International Search Report and Written Opinion for International Application No. PCT/IB2022/062147, mailed Mar. 16, 2023, 12 Pages.
International Search Report and Written Opinion for International Application No. PCT/IB2022/062298, mailed Apr. 21, 2023, 12 Pages.
International Search Report and Written Opinion for International Application No. PCT/IB2023/059175, mailed Dec. 20, 2023, 13 Pages.

* cited by examiner

CONTACT LENS PACKAGES HAVING AN ABSORBENT MEMBER

The present application claims priority to U.S. application Ser. No. 18/154,482, filed Jan. 13, 2023, which is incorporated herein by reference in its entirety.

I. BACKGROUND OF THE INVENTION

In a conventional contact lens package, the contact lens typically sits in a molded plastic base having a cavity (or "bowl") that houses the contact lens in a concave-side-up orientation. As a result, the user experience for transferring a contact lens from the package to an eye generally involves the user "fishing" the contact lens out of the bowl with a finger and then flipping the lens so that it is in the correct orientation on the finger for placement on the eye. This process requires touching the lens multiple times, which can transfer contaminants or pathogens from the hand to the lens and ultimately to the eye. Not only is this handling experience potentially unsanitary, but it is also unduly cumbersome, messy, and mechanically stressful to the lens, which can tear, rip, or distort when overly manipulated. While some packages have been designed to present the lens in a convex-side-up orientation to obviate the need for flipping the lens, they often still require the lens to be "fished" from the packaging solution or otherwise necessitate manipulation of the lens and/or multiple touches of the lens to achieve transfer of the lens to the eye.

In view of the growing awareness around ocular health and the customer demand for a more convenient experience, a need has arisen for contact lens packaging that enables a less messy and more sanitary contact lens handling process. The solution in which the lens is packaged can affect the releasability of the lens from the packaging and the finger. That is, liquid solution in the bowl makes removal of the lens from the bowl more difficult because a hydrophilic lens with excessive liquid reduces surface tension between the human finger and the lens, making adequate adhesion between the lens and the finger difficult to achieve, making it difficult to remove the lens from the package.

Among other considerations, it would be desirable for wearers to be able to drain away any packaging solution which might impact the ability of adhering the lens to the finger, as variation in the amount of packaging solution adhering to the lens and package can impact the process of placing the lens on the finger. A mechanism for efficient draining of packing solution from the lens within the package prior to taking the lens from an opened contact lens package onto a user's finger can aid in the removal and insertion process.

There remains a need for contact lens packages which provide a mechanism for consistent draining of solution away from the contact lens.

II. SUMMARY

It has now been found that some or all the foregoing and related objects may be attained in a contact lens package having one or more aspects described herein. According to certain embodiments, a contact lens package can include a cavity that houses a contact lens, packaging solution, and an absorbent member. In certain embodiments, the absorbent member may be configured for transitioning between an expanded state and a compressed state. As described herein, in some embodiments, the absorbent member may be in the compressed state when the package is in an unopened state and may be configured for transitioning from the compressed state toward the expanded state when the package is transitioned from the unopened state to an opened state. In this manner, as described herein, the absorbent member may be configured for absorbing at least a portion of, and in some instances, a majority of, the packaging solution when the absorbent member transitions from the compressed state toward the expanded state. In some embodiments, the absorption of at least a portion of the packaging solution by the absorbent member when the package is transitioned from the unopened state to an opened state may result in a significant amount of the packaging solution being drained away from the contact lens, thereby improving the ability to adhere the lens to the user's finger for removal from the package and placement onto the user's eye. Moreover, in embodiments in which the absorbent member is biased to transition from the compressed state to the expanded state upon opening the package, the rate of drainage of solution away from the contact lens may be increased as compared to other mechanisms that allow but do not promote such drainage. Further, the inclusion of the absorbent member within the cavity of the package may improve user experience by reducing spillage of packaging solution associated with opening the package, as a significant amount of the solution may be absorbed and contained by the absorbent member. The present disclosure provides various embodiments of contact lens packages, methods of packaging a contact lens, and methods of opening a contact lens package.

In one aspect, a contact lens package is provided. The contact lens package may include a cavity that houses a contact lens, packaging solution, and an absorbent member. The absorbent member may be configured for transitioning between an expanded state and a compressed state, and the absorbent member may be in the compressed state when the package is in an unopened state.

In some embodiments, the absorbent member may be configured for transitioning from the compressed state toward the expanded state when the package is transitioned from the unopened state to an opened state. In some embodiments, the absorbent member may be configured for absorbing at least a portion of the packaging solution when the absorbent member transitions from the compressed state toward the expanded state. In some embodiments, the absorbent member may be configured for absorbing a majority of the packaging solution when the absorbent member transitions from the compressed state toward the expanded state. In some embodiments, the absorbent member may be configured for absorbing at least a portion of the packaging solution when the package is transitioned from the unopened state to an opened state. In some embodiments, the absorbent member may be configured for absorbing a majority of the packaging solution when the package is transitioned from the unopened state to an opened state. In some embodiments, the absorbent member may be biased toward the expanded state. In some embodiments, the absorbent member may be disposed adjacent the contact lens. In some embodiments, the absorbent member may include a sponge.

In some embodiments, the contact lens package also may include a base and a lid connected to the base, and the cavity may be formed between the base and the lid. In some embodiments, the base and the lid may collectively surround the cavity. In some embodiments, the base and the lid may collectively define the cavity. In some embodiments, the lid may be sealed to the base along a perimeter of the cavity when the package is in the unopened state, and the seal between the lid and the base may be at least partially broken when the package is in an opened state. In some embodiments, the lid may be sealed to the base along an entirety of the perimeter of the cavity. In some embodiments, the lid may extend over and cover the contact lens when the package is in the unopened state, and the lid may not cover the contact lens when the package is in an opened state. In some embodiments, the lid may extend over and cover the absorbent member when the package is in the unopened state, and the lid may not cover the absorbent member when the package is in an opened state. In some embodiments, the lid may extend over and cover the absorbent member when the package is in the unopened state, and the lid may extend at least partially over the absorbent member when the package is in an opened state. In some embodiments, the contact lens may be disposed within the cavity such that a convex surface of the contact lens faces the lid when the package is in the unopened state. In some embodiments, the contact lens may be disposed within the cavity such that a convex surface of the contact lens is exposed and accessible to a user when the package is in an opened state. In some embodiments, the contact lens may be disposed within the cavity such that a concave surface of the contact lens faces the base when the package is in the unopened state. In some embodiments, the absorbent member may be connected to the base. In some embodiments, the absorbent member may be connected to the lid.

In some embodiments, the base may include a lens support that supports the contact lens within the cavity. In some embodiments, the lens support may include an internal surface having a convex shape, and the internal surface of the lens support may engage a concave surface of the contact lens. In some embodiments, the internal surface of the lens support may define a portion of the cavity. In some embodiments, the lens support also may include an external surface disposed opposite the internal surface of the lens support and having a concave shape. In some embodiments, the concave shape of the external surface of the lens support may be configured for receiving a convex portion of an adjacent package therein, thereby facilitating stacking of a plurality of the packages in a nested manner. In some embodiments, the lid may extend over and cover the lens support when the package is in the unopened state, and the lid may not cover the lens support when the package is in an opened state. In some embodiments, the base also may include an absorbent-member support that supports the absorbent member within the cavity. In some embodiments, the absorbent-member support may include an internal surface having a planar shape. In some embodiments, the internal surface of the absorbent-member support may define a portion of the cavity. In some embodiments, the absorbent-member support also may include an external surface disposed opposite the internal surface of the absorbent-member support and having a planar shape. In some embodiments, the absorbent member may be connected to the absorbent-member support. In some embodiments, the lid may extend over and cover the absorbent-member support when the package is in the unopened state, and the lid may not cover the absorbent-member support when the package is in an opened state. In some embodiments, the lid may extend over and cover the absorbent-member support when the package is in the unopened state, and the lid may extend at least partially over the absorbent-member support when the package is in an opened state. In some embodiments, the absorbent-member support may be disposed adjacent the lens support. In some embodiments, the lens support may extend above the absorbent-member support and may be configured for facilitating drainage of the packaging solution toward the absorbent member when the package is in an opened state. In some embodiments, the base may be substantially rigid, and the lid may be flexible. In some embodiments, the base may be flexible, and the lid may be flexible. In some embodiments, the lid may include a foil layer.

In another aspect, a contact lens package is provided. The contact lens package may include a base and a lid connected to the base. The base and the lid may collectively define a cavity that houses a contact lens, packaging solution, and an absorbent member. The absorbent member may be configured for transitioning between an expanded state and a compressed state, and the absorbent member may be in the compressed state when the package is in an unopened state.

In some embodiments, the absorbent member may be configured for transitioning from the compressed state toward the expanded state when the package is transitioned from the unopened state to an opened state. In some embodiments, the absorbent member may be configured for absorbing at least a portion of the packaging solution when the absorbent member transitions from the compressed state toward the expanded state. In some embodiments, the absorbent member may be configured for absorbing a majority of the packaging solution when the absorbent member transitions from the compressed state toward the expanded state. In some embodiments, the absorbent member may be configured for absorbing at least a portion of the packaging solution when the package is transitioned from the unopened state to an opened state. In some embodiments, the absorbent member may be configured for absorbing a majority of the packaging solution when the package is transitioned from the unopened state to an opened state. In some embodiments, the absorbent member may be biased toward the expanded state. In some embodiments, the absorbent member may be disposed adjacent the contact lens. In some embodiments, the absorbent member may include a sponge.

In some embodiments, the lid may be sealed to the base along a perimeter of the cavity when the package is in the unopened state, and the seal between the lid and the base may be at least partially broken when the package is in an opened state. In some embodiments, the lid may be sealed to the base along an entirety of the perimeter of the cavity. In some embodiments, the lid may extend over and cover the contact lens when the package is in the unopened state, and the lid may not cover the contact lens when the package is in an opened state. In some embodiments, the lid may extend over and cover the absorbent member when the package is in the unopened state, and the lid may not cover the absorbent member when the package is in an opened state. In some embodiments, the lid may extend over and cover the absorbent member when the package is in the unopened state, and the lid may extend at least partially over the absorbent member when the package is in an opened state. In some embodiments, the contact lens may be disposed within the cavity such that a convex surface of the contact lens faces the lid when the package is in the unopened state. In some embodiments, the contact lens may be disposed within the cavity such that a convex surface of the contact lens is exposed and accessible to a user when the package is in an opened state. In some embodiments, the contact lens may be disposed within the cavity such that a concave surface of the contact lens faces the base when the package is in the unopened state. In some embodiments, the absorbent member may be connected to the base. In some embodiments, the absorbent member may be connected to the lid.

In some embodiments, the base may include a lens support that supports the contact lens within the cavity. In some embodiments, the lens support may include an internal surface having a convex shape, and the internal surface of the lens support may engage a concave surface of the contact lens. In some embodiments, the internal surface of the lens support may define a portion of the cavity. In some embodiments, the lens support also may include an external surface disposed opposite the internal surface of the lens support and having a concave shape. In some embodiments, the concave shape of the external surface of the lens support may be configured for receiving a convex portion of an adjacent package therein, thereby facilitating stacking of a plurality of the packages in a nested manner. In some embodiments, the lid may extend over and cover the lens support when the package is in the unopened state, and the lid may not cover the lens support when the package is in an opened state. In some embodiments, the base also may include an absorbent-member support that supports the absorbent member within the cavity. In some embodiments, the absorbent-member support may include an internal surface having a planar shape. In some embodiments, the internal surface of the absorbent-member support may define a portion of the cavity. In some embodiments, the absorbent-member support also may include an external surface disposed opposite the internal surface of the absorbent-member support and having a planar shape. In some embodiments, the absorbent member may be connected to the absorbent-member support. In some embodiments, the lid may extend over and cover the absorbent-member support when the package is in the unopened state, and the lid may not cover the absorbent-member support when the package is in an opened state. In some embodiments, the lid may extend over and cover the absorbent-member support when the package is in the unopened state, and the lid may extend at least partially over the absorbent-member support when the package is in an opened state. In some embodiments, the absorbent-member support may be disposed adjacent the lens support. In some embodiments, the lens support may extend above the absorbent-member support and may be configured for facilitating drainage of the packaging solution toward the absorbent member when the package is in an opened state. In some embodiments, the base may be substantially rigid, and the lid may be flexible. In some embodiments, the base may be flexible, and the lid may be flexible. In some embodiments, the lid may include a foil layer.

In still another aspect, a method of packaging a contact lens is provided. The method may include disposing a contact lens, packaging solution, and an absorbent member within a cavity of a package, transitioning the absorbent member from an expanded state to a compressed state, and enclosing the cavity such that the absorbent member is maintained in the compressed state when the package is in an unopened state.

In some embodiments, transitioning the absorbent member from the expanded state to the compressed state may include releasing at least a portion of the packaging solution from the absorbent member. In some embodiments, the method also may include, before disposing the absorbent member within the cavity, absorbing at least a portion of the packaging solution with the absorbent member. In some embodiments, the method also may include, before disposing the absorbent member within the cavity, absorbing a majority of the packaging solution with the absorbent member. In some embodiments, the method also may include, before disposing the absorbent member within the cavity, absorbing an entirety of the packaging solution with the absorbent member. In some embodiments, transitioning the absorbent member from the expanded state to the compressed state may include causing at least a portion of the packaging solution to flow within the cavity toward the contact lens. In some embodiments, transitioning the absorbent member from the expanded state to the compressed state may include causing at least a portion of the packaging solution to flow within the cavity from the absorbent member toward the contact lens. In some embodiments, the absorbent member may be biased to the expanded state. In some embodiments, the absorbent member may be disposed adjacent the contact lens. In some embodiments, the absorbent member may include a sponge. In some embodiments, the package may include a base and a lid, the cavity may be formed between the base and the lid, and enclosing the cavity may include connecting the lid to the base such that the absorbent member is maintained in the compressed state between the base and the lid.

In another aspect, a method of opening a contact lens package is provided. The method may include holding the package, with the package including a cavity that houses a contact lens, packaging solution, and an absorbent member. The method also may include at least partially opening the cavity such that the contact lens is uncovered, and allowing the absorbent member to transition from a compressed state toward an expanded state such that the absorbent member absorbs at least a portion of the packaging solution.

In some embodiments, the absorbent member may absorb a majority of the packaging solution. In some embodiments, the absorbent member may be biased to the expanded state. In some embodiments, the absorbent member may be disposed adjacent the contact lens. In some embodiments, the absorbent member may include a sponge. In some embodiments, the package may include a base and a lid, the cavity may be formed between the base and the lid, and the absorbent member may be maintained in the compressed state between the base and the lid when the package is in an unopened state.

These and other aspects and improvements of the present disclosure will become apparent to one of ordinary skill in the art upon review of the following detailed description when taken in conjunction with the accompanying drawings and the appended claims.

III. BRIEF DESCRIPTION OF THE DRAWINGS

The foregoing and other features and advantages of the invention will be apparent from the following, more particular description of certain embodiments of the present disclosure, as illustrated in the accompanying drawings.

Figure 1A:
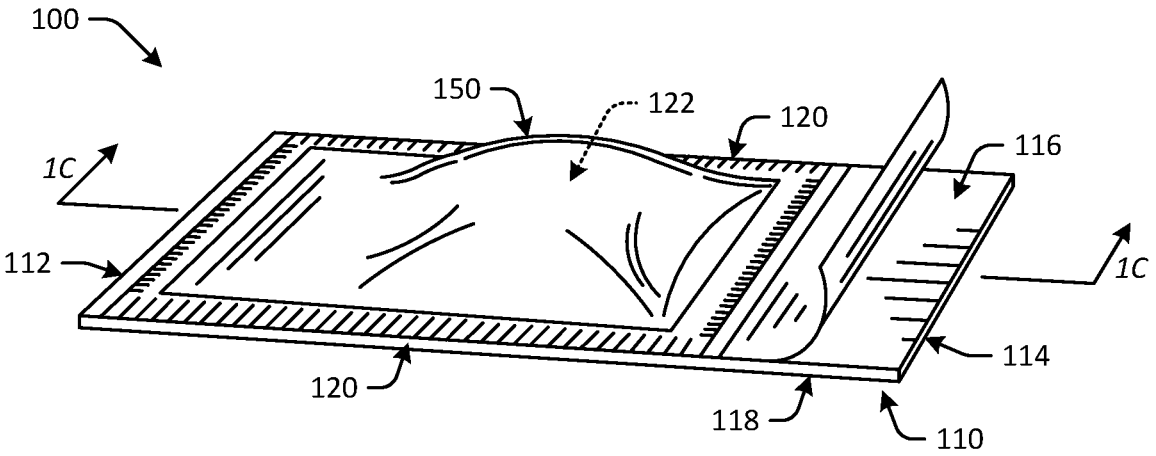
FIG. 1A is a perspective view of an example contact lens package in accordance with embodiments of the disclosure, showing the contact lens package in an unopened state.
Figure 1B:
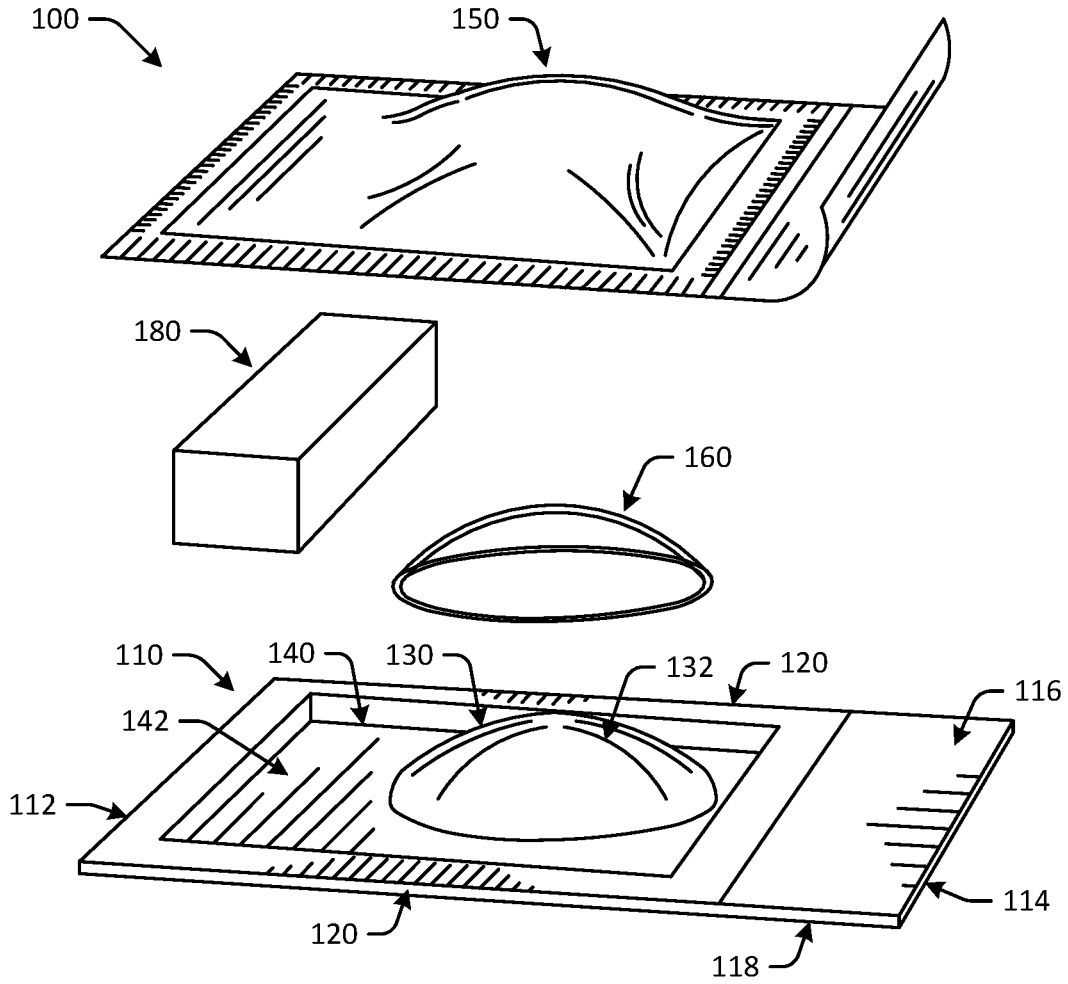
FIG. 1B is an exploded perspective view of the contact lens package of FIG. 1A, showing a base, a lid, a contact lens, and an absorbent member of the contact lens package.
Figure 1C:
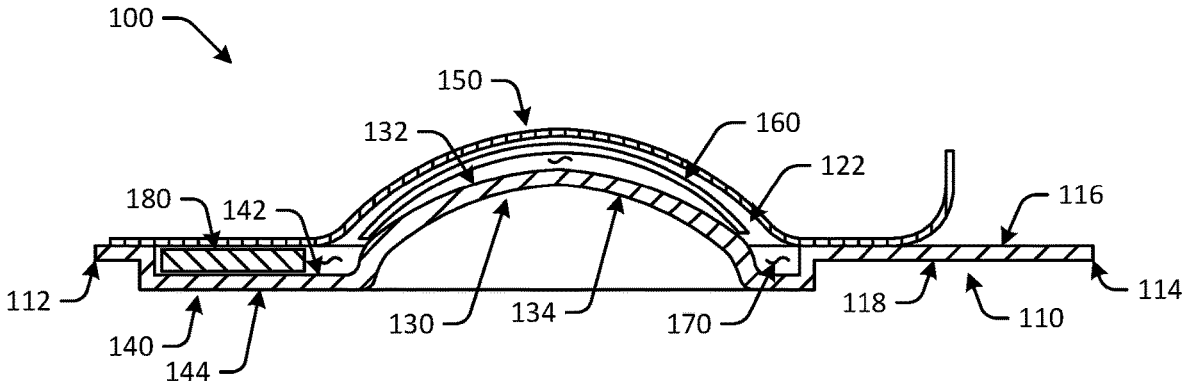
FIG. 1C is a cross-sectional side view of the contact lens package of FIG. 1A, taken along line 1C-1C of FIG. 1A, showing the contact lens package in the unopened state, with the contact lens, packaging solution, and the absorbent member being housed within a cavity of the contact lens package while the absorbent member is in a compressed state.
Figure 1D:
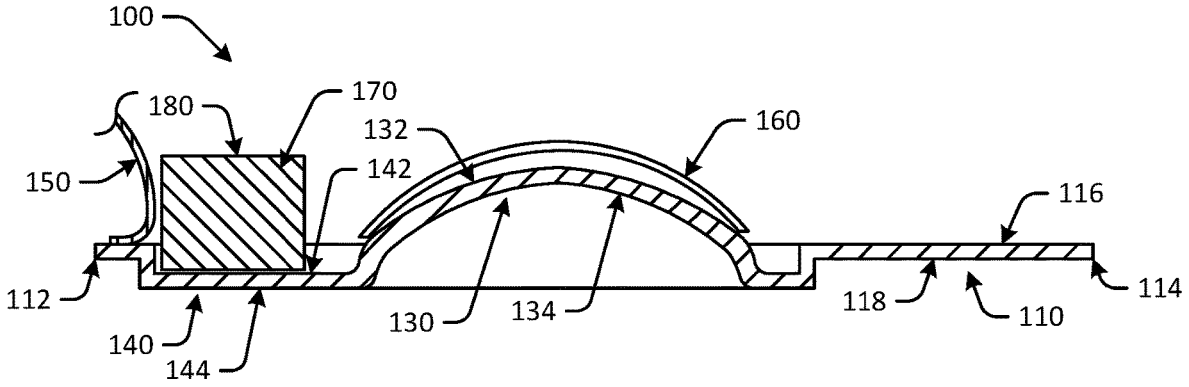

FIG. 1D is a cross-sectional side view of the contact lens package of FIG. 1A, showing the contact lens package in an opened state, with the lid at least partially removed from the base such that the absorbent member transitions from the compressed state to an expanded state, at least a portion of the packaging solution drains away from the contact lens and is absorbed by the absorbent member, and the contact lens is exposed for removal by a user.

IV. DETAILED DESCRIPTION

Reference will now be made in detail to representative embodiments illustrated in the accompanying drawings wherein reference numerals indicate certain elements. The following descriptions are not intended to limit the myriad embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, aspect, or characteristic, but every embodiment may not necessarily include the particular feature, structure, or characteristic. Moreover, such phrases are not necessarily referring to the same embodiment. Further, when a particular feature, structure, aspect, or characteristic is described in connection with an embodiment, it is submitted that it is within the knowledge of one skilled in the art to effect such feature, structure, or characteristic in connection with other embodiments whether or not explicitly described.

Lens(es) or contact lens(es) refer to ophthalmic devices that reside on the eye. They have a generally hemispheric shape and can provide optical correction, cosmetic enhancement, UV blocking and visible light or glare reduction, therapeutic effect, including wound healing, delivery of drugs or neutraceuticals, diagnostic evaluation or monitoring, or any combination thereof. The term lens includes soft hydrogel contact lenses, which are generally provided to the consumer in a package in the hydrated state, and have a relatively low moduli, which allows them to conform to the cornea. Contact lenses suitable for use with the packages of the present invention include all hydrated contact lenses, including conventional and silicone hydrogel contact lenses.

A hydrogel is a hydrated crosslinked polymeric system that contains water in an equilibrium state, and may contain at least about 25%, or at least 35% water in the hydrated state. Hydrogels typically are oxygen permeable and biocompatible, making them excellent materials for producing contact lenses.

Conventional hydrogel contact lenses do not contain silicone containing components, and generally have higher water content, lower oxygen permeability, moduli, and shape memories than silicone hydrogels. Conventional hydrogels are prepared from monomeric mixtures predominantly containing hydrophilic monomers, such as 2-hydroxyethyl methacrylate ("HEMA"), N-vinyl pyrrolidone ("NVP") or polyvinyl alcohols. U.S. Pat. Nos. 4,495,313, 4,889,664 and 5,039,459 disclose the formation of conventional hydrogels. Conventional hydrogels may be ionic or non-ionic and include polymacon, etafilcon, nelfilcon, ocufilcon lenefilcon and the like. The oxygen permeability of these conventional hydrogel materials is typically below 20-30 barrers.

Silicon hydrogel formulations include balafilcon samfilcon, lotrafilcon A and B, delfilcon, galyfilcon, senofilcon A, B and C, narafilcon, comfilcon, formofilcon, riofilcon, fanfilcon, stenfilcon, somofilcon, kalifilcon and the like. "Silicone hydrogels" refer to polymeric networks made from at least one hydrophilic component and at least one silicone-containing component. Silicone hydrogels may have moduli in the range of 60-200, 60-150 or 80-130 psi, water contents in the range of 20 to 60%. Examples of silicone hydrogels include acquafilcon, asmofilcon, balafilcon, comfilcon, delefilcon, enfilcon, fanfilcon, formofilcon, galyfilcon, lotrafilcon, narafilcon, riofilcon, samfilcon, senofilcon, somofilcon, and stenfilcon, verofilcon, including all of their variants, as well as silicone hydrogels as prepared in U.S. Pat. Nos. 4,659,782, 4,659,783, 5,244,981, 5,314,960, 5,331,067, 5,371,147, 5,998,498, 6,087,415, 5,760,100, 5,776,999, 5,789,461, 5,849,811, 5,965,631, 6,367,929, 6,822,016, 6,867,245, 6,943,203, 7,247,692, 7,249,848, 7,553,880, 7,666,921, 7,786,185, 7,956,131, 8,022,158, 8,273,802, 8,399,538, 8,470,906, 8,450,387, 8,487,058, 8,507,577, 8,637,621, 8,703,891, 8,937,110, 8,937,111, 8,940,812, 9,056,878, 9,057,821, 9,125,808, 9,140,825, 9,156,934, 9,170,349, 9,244,196, 9,244,197, 9,260,544, 9,297,928, 9,297,929 as well as WO 03/22321, WO 2008/061992, and US 2010/0048847. These patents are hereby incorporated by reference in their entireties. Silicone hydrogels may have higher shape memory than conventional contact lenses.

Hydrogel lenses are viscoelastic materials. Contact lenses can form optical distortions if the lens interacts with either the package or any air bubble in the package. The extent of the optical distortions, and the length of time needed for the distortions to relax out will vary depending on the chemistry, and to a lesser extent, geometry of the lens. Conventional lens materials, such as polyhydroxyethyl methacrylate-based lenses like etafilcon A or polymacon have low loss modulus and tan delta compared to silicone hydrogels and may form fewer and less severe optical distortions as a result of contact with packaging. The incorporation of silicones (which generally increase the bulk elastic response), wetting agents such as PVP (which generally increase the viscous response) or coatings of conventional hydrogel materials (which may lower the elastic response at the lens interface) can alter the lens viscoelastic properties. Conventional hydrogel contact lenses and silicone hydrogel contact lenses having short or stiff crosslinking agents and or stiffening agent have short shape memories and may be less susceptible to deformation during storage. As used herein, high or higher shape memory hydrogels display optical distortions from contact with an air bubble or package of at least about 0.18 after 5 weeks of accelerated aging at 55° C. Viscoelastic properties, including loss modulus and tan delta, can be measured using a dynamic mechanical analysis.

The contact lenses can be of any geometry or power, and have a generally hemispherical shape, with a concave posterior side which rests against the eye when in use and a convex anterior side which faces away from the eye and is contacted by the eyelid during blinking.

The center or apex of the lens is the center of the lens optic zone. The optic zone provides optical correction and may have a diameter between about 7 mm and about 10 mm. The lens periphery or lens edge is the edge where the anterior and posterior sides meet.

The wetted lens is the contact lens and any residual packaging solution attached to it after packaging solution drainage. Wetted contact is the aggregated contact area between the wetted lens and lens support.

Embodiments may include a lens support surrounded by a sealable cavity also interchangeably referred to as a chamber. The cavity may have any convenient form and may comprise a package base and at least a lid, each of which are described in detail below. As used herein, the phrases "the lid", "a lid", "the base" and "a base" encompass both the singular and plural. The lid and package base are sealed to each other to form a cavity which holds the contact lens, support and packaging solution in a sterile state during shipping and storage prior to use. The contact lens package is made from materials which are compatible with the contact lens and solution, as well as retortable and biologically inert.

"Film" or "multilayer film" are films used to seal the package and are often referred to as lidstock. Multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

An "unopened state" or "unopened" as used herein refers to a contact lens package that is closed and houses a contact lens in solution.

An "opened state" or "opened" as used herein refers to a contact lens package after the sterile seal has been broken. Depending on the context described herein, the opened state extends to the state of the package when the user has manipulated the package to cause the lens to be lifted out of the packaging solution for transfer by the user.

A "wearer" or "user" as used herein refers to a person opening a contact lens package. The user is generally referred to as the person who both opens the package and transfers the contact lens contained therein to their eye. However, the user in some contexts may be a person handling the lens package on behalf of the wearer, such an eye care provider ("ECP") or another individual demonstrating for or assisting the wearer.

Packaging solution is any physiologically compatible solution, which is compatible with the selected lens material and packaging. Packaging solutions include buffered solutions having a physiological pH, such as buffered saline solutions. The packaging solution may contain known components, including buffers, pH and tonicity adjusting agents, lubricants, wetting agents, nutraceuticals, pharmaceuticals, in package coating components and the like.

The package base may form the bottom of the package. It can be made from any material suitable for packaging medical devices, including plastic. The packaging lid generally resides at the upper portion the package and seals with the base to form a cavity containing at least a portion of the lens support, lens, and packaging solution. The lid may be made from any material suitable for packaging medical devices, including a molded sheet of foil or plastic, laminate films, or plastic. Packages comprising plastic for one structure and foil or laminated films as the other, or packages comprising foil or laminated films as the outer layer for the lid and base are known in the art and are examples of suitable combinations.

References throughout this description to injection molding processes and the use of materials conventionally applied to injection molding should be understood as exemplary. Those of skill in the art will appreciate that other means of manufacture are possible within the scope of the appended claims, including but not limited to alternative molding processes, thermoforming, 3D printing, and the like. Likewise, references to heat seals and heat sealing are exemplary to embodiments described herein. Other means of securing packaging components will be apparent to those skilled in the art, including the use of adhesive, glue, thermal bonding, welding such as heat, ultrasonic or laser welding, or a mechanical trap, and the like.

Certain aspects of the invention may serve to reduce or prevent significant optical damage to the contact lens due to interactions with air bubbles or the interior of the lens package that may arise during storage or transit due to gravitational or other forces, such as mechanical pressure being applied from outside of the package. As used herein, significant optical damage means a root-mean-squared (RMS) value equal or greater than about 0.08 μm.

Referring now to the drawings, FIGS. 1A-1D illustrate an example contact lens package 100 in accordance with embodiments of the present disclosure. As described, the contact lens package 100 may include a base 110, a lid 150, a contact lens 160, packaging solution 170, and an absorbent member 180. The contact lens package 100 may have an unopened state, as shown in FIGS. 1A and 1C, and an opened state, as shown in FIG. 1D. When the contact lens package 100 is in the unopened state, the contact lens 160, the packaging solution 170, and the absorbent member 180 may be housed within a cavity 122 formed between the base 110 and the lid 150. As described below, the absorbent member 180 may be compressible and may be maintained in a compressed state within the cavity 122 when the contact lens package 100 is in the unopened state, which may cause a majority of the packaging solution 170 to be disposed about and in contact with the contact lens 160 for maintaining hydration of the lens 160. In this manner, when the contact lens package 100 is in the unopened state, only a minimal amount of the packaging solution 170 may be contained within the absorbent member 180. When desired, a user may open the contact lens package 100 by at least partially removing the lid 150 from the base 110 to allow access to the contact lens 160. Such opening of the contact lens package 100 may allow the absorbent member 180 to transition from the compressed state to an expanded state such that the absorbent member 180 absorbs a significant amount of the packaging solution 170, effectively draining the packaging solution 170 away from the contact lens 160. In this manner, such drainage of the packaging solution 170 away from the contact lens 160 may allow a user to remove the contact lens 160 more easily from the contact lens package 100. The at least partial removal of the lid 150 from the base 110 may expose the contact lens 160, allowing the user to engage and remove the contact lens 150 with the user's finger. As shown, a lens support 130 of the base 110 may maintain a position and orientation of the contact lens 160 within the cavity 122 when the contact lens package 100 is in the unopened state. As shown in FIG. 1C, the contact lens 160 may be housed within the cavity 122 and supported by the lens support 130 such that a convex surface of the contact lens 160 faces the lid 150 when the contact lens package 100 is in the unopened state. In this manner, when the contact lens package 100 is opened, the user may engage the convex surface for removal of the contact lens 160 and subsequent placement of the contact lens 160 on the user's eye, enabling a convenient and more sanitary experience and avoiding the drawbacks of certain existing contact lens packages.

According to the illustrated example, the base 110 may have a first end 112 (which also may be referred to as a "back end" in certain embodiments) and a second end 114 (which also may be referred to as a "front end" in certain embodiments) disposed opposite one another. As shown, the base 110 may have a first side 116 (which also may be referred to as a "top side" in certain embodiments) and a second side 118 (which also may be referred to as a "bottom side" in certain embodiments) disposed opposite one another and each extending from the first end 112 to the second end 114. The base 110 also may have a pair of lateral sides 120 disposed opposite one another and each extending from the first end 112 to the second end 114. In some embodiments, as shown, the base 110 may include certain portions having a planar shape and other portions having a contoured shape. In some embodiments, as shown, the base 110 may include a main portion having a planar shape, an absorbent-member support 140 that is recessed relative to the main portion and has a planar shape, and a lens support 130 that extends upward from the absorbent-member support 140 beyond the main portion and has a contoured shape. In some embodiments, as shown, the base 110 may define a base cavity that forms a portion of the overall cavity 122 of the contact lens package 100. As discussed above, the base 110 may be formed of any suitable material. In certain embodiments, the base 110 may be substantially rigid. In other embodiments, the base 110 may be flexible.

The lens support 130 may at least partially define the cavity 122 and may support the contact lens 160 in a desired position and orientation within the cavity 122. As shown, the lens support 130 may extend upward from the absorbent-member support 140 and may support the contact lens 160 between the base 110 and the lid 150. In some embodiments, as shown, the lens support 130 may be integrally formed with a remainder of the base 110. In other embodiments, the lens support 130 may be separately formed and connected to the remainder of the base 110. In some embodiments, the lens support 130 may be provided as a separate component that is disposed within the cavity 122 between the base 110 and the lid 150 and is connected to the base 110, for example, by an adhesive or other means of attachment. As shown, the lens support 130 may include an internal surface 132 (which also may be referred to as a "support surface" in certain embodiments) that engages and supports the contact lens 160 within the cavity 122. In particular, the internal surface 132 may engage the concave surface of the contact lens 160. In some embodiments, the internal surface 132 may be a convex surface, although other shapes of the internal surface 132 may be used in other embodiments. As shown, the lens support 130 may be formed as a dome extending upward from the absorbent-member support 140, and the internal surface 132 may be a convex outer surface of the dome. As shown, the lens support 130 may include an external surface 134 disposed opposite the internal surface 132 and defining an external portion of the contact lens package 100. In some embodiments, the external surface 134 may be a convex surface, with the convex shape thereof facilitating nesting of multiple contact lens packages 100 disposed adjacent one another, such as in a stack, although other shapes of the external surface 134 may be used in other embodiments. The lens support 130 may be formed of any suitable material. In some embodiments, the lens support 130 may be substantially rigid.

The absorbent-member support 140 may at least partially define the cavity 122 and may support the absorbent member 180 in a desired position and orientation within the cavity 122. As shown, the absorbent-member support 140 may be recessed relative to the main planar portion of the base 110 and may support the absorbent member 180 between the base 110 and the lid 150. In some embodiments, as shown, the absorbent-member support 140 may be integrally formed with a remainder of the base 110. In other embodiments, the absorbent-member support 140 may be separately formed and connected to the remainder of the base 110. In some embodiments, the absorbent-member support 140 may be provided as a separate component that is disposed within the cavity 122 between the base 110 and the lid 150 and is connected to the base 110, for example, by an adhesive or other means of attachment. As shown, the absorbent-member support 140 may include an internal surface 142 (which also may be referred to as a "support surface" in certain embodiments) that engages and supports the absorbent member 180 within the cavity 122. In particular, the internal surface 142 may engage a bottom surface of the absorbent member 180. In some embodiments, as shown the internal surface 142 may be a planar surface, although other contoured shapes of the internal surface 142 may be used in other embodiments. As shown, the absorbent-member support 140 may include an external surface 144 disposed opposite the internal surface 142 and defining an external portion of the contact lens package 100. In some embodiments, the external surface 144 may be a planar surface, although other shapes of the external surface 144 may be used in other embodiments. The absorbent-member support 140 may be formed of any suitable material. In some embodiments, the absorbent-member support 140 may be substantially rigid.

As shown, the lid 150 may be connected to the base 110 and may extend over at least part of the base 110 and seal the contact lens 160, the packaging solution 170, and the absorbent member 180 within the cavity 122 when the contact lens package 100 is in the unopened state. In this manner, the base 110 and the lid 150 together may form the sealed cavity 122 for containing the contact lens 160, the packaging solution 170, and the absorbent member 180 until a user desires to open the contact lens package 100 and remove the contact lens 160 for use. In some embodiments, as shown, when the contact lens package 100 is in the unopened state, the lid 150 may extend over and cover the lens support 130, the absorbent-member support 140, and other respective portions of the base 110. When the contact lens package 100 is in the unopened state, respective portions of the lid 150 may be sealed to respective adjacent portions of the base 110, such as portions of the main portion of the base 110 surrounding the lens support 130 and the absorbent-member support 140, such that the contact lens 160, the packaging solution 170, and the absorbent member 180 are contained within the cavity 122 formed by the base 110 and the lid 150. The seal between the lid 150 and the base 110 may be at least partially broken when the contact lens package 100 is transitioned from the unopened state to an opened state for removal of the contact lens 160. As discussed above, the lid 150 may be formed of any suitable material. In certain embodiments, as shown, the lid 150 may be flexible.

The absorbent member 180 may be compressible and configured for transitioning between a compressed state, as shown in FIG. 1C, and an expanded state, as shown in FIGS. 1B and 1D. In some embodiments, as shown, the absorbent member 180 may be biased toward the expanded state. In this manner, when the contact lens package 100 is in the unopened state, the absorbent member 180 may be compressed between the base 110 and the lid 150 and maintained in the compressed state, and when the contact lens package 100 is transitioned from the unopened state to an opened state, the absorbent member 180 may automatically transition from the compressed state to the expanded state. As discussed above, such transitioning of the absorbent member 180 from the compressed state to the expanded state may allow the absorbent member 180 to quickly absorb the packaging solution 170, thereby facilitating drainage of the packaging solution 170 away from the contact lens 160. In some embodiments, the absorbent member 180 may be configured for absorbing at least a portion of the packaging solution 170 when the absorbent member 180 transitions from the compressed state toward the expanded state. In some embodiments, the absorbent member 180 may be configured for absorbing a majority of the packaging solution 170 when the absorbent member 180 transitions from the compressed state toward the expanded state. In some embodiments, the absorbent member 180 may be configured for absorbing at least a portion of the packaging solution 170 when the contact lens package 100 is transitioned from the unopened state to an opened state. In some embodiments, the absorbent member 180 may be configured for absorbing a majority of the packaging solution 170 when the contact lens package 100 is transitioned from the unopened state to an opened state. In some embodiments, the absorbent member 180 may be disposed near but slightly spaced apart from the contact lens 160. In some embodiments, the absorbent member 180 may be disposed adjacent the contact lens 160. In some embodiments, the absorbent member 180 may be formed of or may include a sponge. In some embodiments, the absorbent member 180 may be formed of or may include a foam. In some embodiments, the absorbent member 180 may be formed of or may include a chamois or shammy material. Various other suitable configurations and materials may be used for the absorbent member 180.

FIGS. 1C and 1D illustrate an example method of opening the contact lens package 100 in accordance with embodiments of the present disclosure. As noted above, the contact lens package 100 may be provided and stored in the unopened state, as shown in FIGS. 1A and 1C, until a user desires to open the package 100. With the contact lens package 100 in the unopened state, the user may hold the base 110 and grasp an end region of the lid 150, such as the end region of the lid 150 that is not directly connected to the base 110, as shown in FIG. 1C. The user may at least partially remove the lid 150 from the base 110 by pulling the end region of the lid 150 away from the base 110. In this manner, at least a portion of the seal between the lid 150 and the base 110 may be broken. As shown in FIG. 1D, the lid 150 may be removed from the base 110 such that the contact lens 160, the lens support 130, and at least a portion of the absorbent member 180 are no longer covered by the lid 150. In some embodiments, as shown, the entirety of the absorbent member 180 may be exposed, allowing the absorbent member 180 to fully transition from the compressed state to the expanded state. In some embodiments, the lid 150 may be entirely removed from the base 110. As discussed above, when the lid 150 is at least partially removed from the base 110, the absorbent member 180 may transition from the compressed state toward or to the expanded state, such that at least a portion of the packaging solution 170 is absorbed by the absorbent member 180 and drained away from the contact lens 160. After at least partially removing the lid 150 from the base 110, as shown in FIG. 1D, the user may engage the contact lens 160 while the contact lens 160 is exposed and supported by the lens support 130. According to the illustrated embodiment in which the lens support 130 supports the concave surface of the contact lens 160, the user may engage the convex surface of the contact lens 160 and remove the contact lens 160 from the lens support 130. As discussed above, by allowing at least a portion of the packaging solution 170 to drain away from the contact lens 160 and be absorbed and contained by the absorbent member 180, the user may be able to easily engage and retain the contact lens 160 with the user's finger. In this manner, the contact lens 160 may be conveniently removed from the lens support 130 and held on the user's finger in the desired concave-side-up orientation, ready for positioning on the user's eye.

An example method of packaging the contact lens 160 using the contact lens package 100 also may be appreciated from FIGS. 1C and 1D. The method generally may include disposing the contact lens 160, the packaging solution 170, and the absorbent member 180 within the cavity 122 of the package 100, as shown in FIG. 1D, transitioning the absorbent member 180 from an expanded state to a compressed state, and enclosing the cavity 122 such that the absorbent member 180 is maintained in the compressed state when the package 100 is in an unopened state, as shown in FIG. 1C. In some embodiments, at least a portion of, a majority of, or an entirety of the packaging solution 170 may be applied to and absorbed by the absorbent member 180 either before or after the absorbent member 180 is placed on the base 110. In this manner, the transitioning of the absorbent member 180 from the expanded state to the compressed state may include releasing at least a portion of the packaging solution 170 from the absorbent member 180 and causing at least a portion of the packaging solution 170 to flow from the absorbent member 180 toward the contact lens 160 for the purpose of hydrating the contact lens 160 within the cavity 122. In some embodiments, as shown, enclosing the cavity 122 may include connecting the lid 150 to the base 110 such that the absorbent member 180 is maintained in the compressed state between the base 110 and the lid 150.

Some aspect of the invention may be further understood with reference to the following examples:

Example 1. A contact lens package comprising:

a cavity that houses a contact lens, packaging solution, and an absorbent member, wherein the absorbent member is configured for transitioning between an expanded state and a compressed state, and wherein the absorbent member is in the compressed state when the package is in an unopened state.

Example 2. The contact lens package of example 1, wherein the absorbent member is configured for transitioning from the compressed state toward the expanded state when the package is transitioned from the unopened state to an opened state.

Example 3. The contact lens package of example 1 or example 2, wherein the absorbent member is configured for absorbing at least a portion of the packaging solution when the absorbent member transitions from the compressed state toward the expanded state.

Example 4. The contact lens package of any one of examples 1-3, wherein the absorbent member is configured for absorbing a majority of the packaging solution when the absorbent member transitions from the compressed state toward the expanded state.

Example 5. The contact lens package of any one of examples 1-4, wherein the absorbent member is configured for absorbing at least a portion of the packaging solution when the package is transitioned from the unopened state to an opened state.

Example 6. The contact lens package of any one of examples 1-5, wherein the absorbent member is configured for absorbing a majority of the packaging solution when the package is transitioned from the unopened state to an opened state.

Example 7. The contact lens package of any one of examples 1-6, wherein the absorbent member is biased toward the expanded state.

Example 8. The contact lens package of any one of examples 1-7, wherein the absorbent member is disposed adjacent the contact lens.

Example 9. The contact lens package of any one of examples 1-8, wherein the absorbent member comprises a sponge.

Example 10. The contact lens package of any one of examples 1-9, further comprising a base and a lid connected to the base, wherein the cavity is formed between the base and the lid.

Example 11. The contact lens package of example 10, wherein the base and the lid collectively surround the cavity.

Example 12. The contact lens package of example 10 or example 11, wherein the base and the lid collectively define the cavity.

Example 13. The contact lens package of any one of examples 10-12, wherein the lid is sealed to the base along a perimeter of the cavity when the package is in the unopened state, and wherein the seal between the lid and the base is at least partially broken when the package is in an opened state.

Example 14. The contact lens package of example 13, wherein the lid is sealed to the base along an entirety of the perimeter of the cavity.

Example 15. The contact lens package of any one of examples 10-14, wherein the lid extends over and covers the contact lens when the package is in the unopened state, and wherein the lid does not cover the contact lens when the package is in an opened state.

Example 16. The contact lens package of any one of examples 10-15, wherein the lid extends over and covers the absorbent member when the package is in the unopened state, and wherein the lid does not cover the absorbent member when the package is in an opened state.

Example 17. The contact lens package of any one of examples 10-15, wherein the lid extends over and covers the absorbent member when the package is in the unopened state, and wherein the lid extends at least partially over the absorbent member when the package is in an opened state.

Example 18. The contact lens package of any one of examples 10-17, wherein the contact lens is disposed within the cavity such that a convex surface of the contact lens faces the lid when the package is in the unopened state.

Example 19. The contact lens package of any one of examples 10-18, wherein the contact lens is disposed within the cavity such that a convex surface of the contact lens is exposed and accessible to a user when the package is in an opened state.

Example 20. The contact lens package of any one of examples 10-19, wherein the contact lens is disposed within the cavity such that a concave surface of the contact lens faces the base when the package is in the unopened state.

Example 21. The contact lens package of any one of examples 10-20, wherein the absorbent member is connected to the base.

Example 22. The contact lens package of any one of examples 10-21, wherein the absorbent member is connected to the lid.

Example 23. The contact lens package of any one of examples 10-22, wherein the base comprises a lens support that supports the contact lens within the cavity.

Example 24. The contact lens package of example 23, wherein the lens support comprises an internal surface having a convex shape, and wherein the internal surface of the lens support engages a concave surface of the contact lens.

Example 25. The contact lens package of example 24, wherein the internal surface of the lens support defines a portion of the cavity.

Example 26. The contact lens package of example 24 or example 25, wherein the lens support further comprises an external surface disposed opposite the internal surface of the lens support and having a concave shape.

Example 27. The contact lens package of example 26, wherein the concave shape of the external surface of the lens support is configured for receiving a convex portion of an adjacent package therein, thereby facilitating stacking of a plurality of the packages in a nested manner.

Example 28. The contact lens package of any one of examples 23-27, wherein the lid extends over and covers the lens support when the package is in the unopened state, and wherein the lid does not cover the lens support when the package is in an opened state.

Example 29. The contact lens package of any one of examples 23-28, wherein the base further comprises an absorbent-member support that supports the absorbent member within the cavity.

30. The contact lens package of example 29, wherein the absorbent-member support comprises an internal surface having a planar shape.

Example 31. The contact lens package of example 30, wherein the internal surface of the absorbent-member support defines a portion of the cavity.

Example 32. The contact lens package of example 30 or example 31, wherein the absorbent-member support further comprises an external surface disposed opposite the internal surface of the absorbent-member support and having a planar shape.

Example 33. The contact lens package of any one of examples 30-32, wherein the absorbent member is connected to the absorbent-member support.

Example 34. The contact lens package of any one of examples 30-33, wherein the lid extends over and covers the absorbent-member support when the package is in the unopened state, and wherein the lid does not cover the absorbent-member support when the package is in an opened state.

Example 35. The contact lens package of any one of examples 30-33, wherein the lid extends over and covers the absorbent-member support when the package is in the unopened state, and wherein the lid extends at least partially over the absorbent-member support when the package is in an opened state.

Example 36. The contact lens package of any one of examples 30-35, wherein the absorbent-member support is disposed adjacent the lens support.

Example 37. The contact lens package of any one of examples 30-36, wherein the lens support extends above the absorbent-member support and is configured for facilitating drainage of the packaging solution toward the absorbent member when the package is in an opened state.

Example 38. The contact lens package of any one of examples 10-37, wherein the base is substantially rigid, and wherein the lid is flexible.

Example 39. The contact lens package of any one of examples 10-37, wherein the base is flexible, and wherein the lid is flexible.

Example 40. The contact lens package of any one of examples 10-39, wherein the lid comprises a foil layer.

Example 41. A contact lens package comprising:

a base; and a lid connected to the base, wherein the base and the lid collectively define a cavity that houses a contact lens, packaging solution, and an absorbent member, wherein the absorbent member is configured for transitioning between an expanded state and a compressed state, and wherein the absorbent member is in the compressed state when the package is in an unopened state.

Example 42. The contact lens package of example 41, wherein the absorbent member is configured for transitioning from the compressed state toward the expanded state when the package is transitioned from the unopened state to an opened state.

Example 43. The contact lens package of example 41 or example 42, wherein the absorbent member is configured for absorbing at least a portion of the packaging solution when the absorbent member transitions from the compressed state toward the expanded state.

Example 44. The contact lens package of any one of examples 41-43, wherein the absorbent member is configured for absorbing a majority of the packaging solution when the absorbent member transitions from the compressed state toward the expanded state.

Example 45. The contact lens package of any one of examples 41-44, wherein the absorbent member is configured for absorbing at least a portion of the packaging solution when the package is transitioned from the unopened state to an opened state.

Example 46. The contact lens package of any one of examples 41-45, wherein the absorbent member is configured for absorbing a majority of the packaging solution when the package is transitioned from the unopened state to an opened state.

Example 47. The contact lens package of any one of examples 41-46, wherein the absorbent member is biased toward the expanded state.

Example 48. The contact lens package of any one of examples 41-47, wherein the absorbent member is disposed adjacent the contact lens.

Example 49. The contact lens package of any one of examples 41-48, wherein the absorbent member comprises a sponge.

Example 50. The contact lens package of any one of examples 41-49, wherein the lid is sealed to the base along a perimeter of the cavity when the package is in the unopened state, and wherein the seal between the lid and the base is at least partially broken when the package is in an opened state.

Example 51. The contact lens package of example 50, wherein the lid is sealed to the base along an entirety of the perimeter of the cavity.

Example 52. The contact lens package of any one of examples 41-51, wherein the lid extends over and covers the contact lens when the package is in the unopened state, and wherein the lid does not cover the contact lens when the package is in an opened state.

Example 53. The contact lens package of any one of examples 41-52, wherein the lid extends over and covers the absorbent member when the package is in the unopened state, and wherein the lid does not cover the absorbent member when the package is in an opened state.

Example 54. The contact lens package of any one of examples 41-52, wherein the lid extends over and covers the absorbent member when the package is in the unopened state, and wherein the lid extends at least partially over the absorbent member when the package is in an opened state.

Example 55. The contact lens package of any one of examples 41-54, wherein the contact lens is disposed within the cavity such that a convex surface of the contact lens faces the lid when the package is in the unopened state.

Example 56. The contact lens package of any one of examples 41-55, wherein the contact lens is disposed within the cavity such that a convex surface of the contact lens is exposed and accessible to a user when the package is in an opened state.

Example 57. The contact lens package of any one of examples 41-56, wherein the contact lens is disposed within the cavity such that a concave surface of the contact lens faces the base when the package is in the unopened state.

Example 58. The contact lens package of any one of examples 41-57, wherein the absorbent member is connected to the base.

Example 59. The contact lens package of any one of examples 41-58, wherein the absorbent member is connected to the lid.

Example 60. The contact lens package of any one of examples 41-59, wherein the base comprises a lens support that supports the contact lens within the cavity.

Example 61. The contact lens package of example 60, wherein the lens support comprises an internal surface having a convex shape, and wherein the internal surface of the lens support engages a concave surface of the contact lens.

Example 62. The contact lens package of example 61, wherein the internal surface of the lens support defines a portion of the cavity.

Example 63. The contact lens package of example 61 or example 62, wherein the lens support further comprises an external surface disposed opposite the internal surface of the lens support and having a concave shape.

Example 64. The contact lens package of example 63, wherein the concave shape of the external surface of the lens support is configured for receiving a convex portion of an adjacent package therein, thereby facilitating stacking of a plurality of the packages in a nested manner.

Example 65. The contact lens package of any one of examples 60-64, wherein the lid extends over and covers the lens support when the package is in the unopened state, and wherein the lid does not cover the lens support when the package is in an opened state.

Example 66. The contact lens package of any one of examples 60-65, wherein the base further comprises an absorbent-member support that supports the absorbent member within the cavity.

Example 67. The contact lens package of example 66, wherein the absorbent-member support comprises an internal surface having a planar shape.

Example 68. The contact lens package of example 67, wherein the internal surface of the absorbent-member support defines a portion of the cavity.

Example 69. The contact lens package of example 67 or example 68, wherein the absorbent-member support further comprises an external surface disposed opposite the internal surface of the absorbent-member support and having a planar shape.

Example 70. The contact lens package of any one of examples 66-69, wherein the absorbent member is connected to the absorbent-member support.

Example 71. The contact lens package of any one of examples 66-70, wherein the lid extends over and covers the absorbent-member support when the package is in the unopened state, and wherein the lid does not cover the absorbent-member support when the package is in an opened state.

Example 72. The contact lens package of any one of examples 66-70, wherein the lid extends over and covers the absorbent-member support when the package is in the unopened state, and wherein the lid extends at least partially over the absorbent-member support when the package is in an opened state.

Example 73. The contact lens package of any one of examples 66-72, wherein the absorbent-member support is disposed adjacent the lens support.

Example 74. The contact lens package of any one of examples 66-73, wherein the lens support extends above the absorbent-member support and is configured for facilitating drainage of the packaging solution toward the absorbent member when the package is in an opened state.

Example 75. The contact lens package of any one of examples 41-74, wherein the base is substantially rigid, and wherein the lid is flexible.

Example 76. The contact lens package of any one of examples 41-74, wherein the base is flexible, and wherein the lid is flexible.

Example 77. The contact lens package of any one of examples 41-76, wherein the lid comprises a foil layer.

Example 78. A method of packaging a contact lens, the method comprising:

disposing a contact lens, packaging solution, and an absorbent member within a cavity of a package;

transitioning the absorbent member from an expanded state to a compressed state; and enclosing the cavity such that the absorbent member is maintained in the compressed state when the package is in an unopened state.

Example 79. The method of example 78, wherein transitioning the absorbent member from the expanded state to the compressed state comprises releasing at least a portion of the packaging solution from the absorbent member.

Example 80. The method of example 78 or example 79, further comprising, before disposing the absorbent member within the cavity, absorbing at least a portion of the packaging solution with the absorbent member.

Example 81. The method of example 78 or example 79, further comprising, before disposing the absorbent member within the cavity, absorbing a majority of the packaging solution with the absorbent member.

Example 82. The method of example 78 or example 79, further comprising, before disposing the absorbent member within the cavity, absorbing an entirety of the packaging solution with the absorbent member.

Example 83. The method of any one of examples 78-82, wherein transitioning the absorbent member from the expanded state to the compressed state comprises causing at least a portion of the packaging solution to flow within the cavity toward the contact lens.

Example 84. The method of any one of examples 78-82, wherein transitioning the absorbent member from the expanded state to the compressed state comprises causing at least a portion of the packaging solution to flow within the cavity from the absorbent member toward the contact lens.

Example 85. The method of any one of examples 78-84, wherein the absorbent member is biased to the expanded state.

Example 86. The method of any one of examples 78-85, wherein the absorbent member is disposed adjacent the contact lens.

Example 87. The method of any one of examples 78-86, wherein the absorbent member comprises a sponge.

Example 88. The method of any one of examples 78-87, wherein the package comprises a base and a lid, wherein the cavity is formed between the base and the lid, and wherein enclosing the cavity comprises connecting the lid to the base such that the absorbent member is maintained in the compressed state between the base and the lid.

Example 89. A method of opening a contact lens package, the method comprising:

holding the package, the package comprising a cavity that houses a contact lens, packaging solution, and an absorbent member;

at least partially opening the cavity such that the contact lens is uncovered; and allowing the absorbent member to transition from a compressed state toward an expanded state such that the absorbent member absorbs at least a portion of the packaging solution.

Example 90. The method of example 89, the absorbent member absorbs a majority of the packaging solution.

Example 91. The method of example 89 or example 90, wherein the absorbent member is biased to the expanded state.

Example 92. The method of any one of examples 89-91, wherein the absorbent member is disposed adjacent the contact lens.

Example 93. The method of any one of examples 89-92, wherein the absorbent member comprises a sponge.

Example 94. The method of any one of examples 89-93, wherein the package comprises a base and a lid, wherein the cavity is formed between the base and the lid, and wherein the absorbent member is maintained in the compressed state between the base and the lid when the package is in an unopened state.

The foregoing description, for purposes of explanation, used specific nomenclature to provide a thorough understanding of the described embodiments. However, it will be apparent to one skilled in the art that many of the specific details are not required in order to practice the described embodiments. Thus, the foregoing descriptions of the specific embodiments described herein are presented for the purposes of illustration and description. They are not targeted to be exhaustive or to limit the embodiments to the precise forms disclosed. It will be apparent to one of ordinary skill in the art that many modifications and variations are possible in view of the above teachings.

The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The packages of the present invention may be manufactured using known materials and processes. The packaging materials may be virgin, recycled or a combination thereof. The volume within the package cavity can vary depending on the design selected.

Not all the features described herein need to be incorporated into every package, and those of skill in the art, using the teachings herein, can combine the features to provide a wide variety of improved contact lens packages. In summary, the contact lens packages of the present invention incorporate several novel functionalities which may be combined in a wide variety of combinations as described herein to provide the desired improved packaging. The breadth and scope of the present invention should not be limited by any of the above-described exemplary embodiments but should be defined only in accordance with the following claims and their equivalents.

What is claimed is:

1. A contact lens package comprising:

a base; and a lid connected to the base, wherein the base and the lid collectively define a cavity that houses a contact lens, packaging solution, and an absorbent member;

the base comprises a lens support comprising an internal surface having a convex shape, and the internal surface of the lens support engages a concave surface of the contact lens and supports the contact lens within the cavity;

the absorbent member is configured for transitioning between an expanded state and a compressed state, and the absorbent member is in the compressed state when the package is in an unopened state;

wherein the base further comprises an absorbent-member support, disposed adjacent the lens support, that supports the absorbent member within the cavity.

2. The contact lens package of claim 1 wherein the internal surface of the lens support defines a portion of the cavity.

3. The contact lens package of claim 1 wherein the lens support comprises an external surface disposed opposite the internal surface of the lens support and having a concave shape.

4. The contact lens package of claim 3 wherein the concave shape of the external surface of the lens support is configured to receive a convex portion of an adjacent contact lens package.

5. The contact lens package of claim 1, wherein the absorbent member is configured for transitioning from the compressed state toward the expanded state when the package is transitioned from the unopened state to an opened state.

6. The contact lens package of claim 1, wherein the absorbent member is configured for absorbing at least a portion of the packaging solution when the absorbent member transitions from the compressed state toward the expanded state.

7. The contact lens package of claim 1, wherein the absorbent member is configured for absorbing a majority of the packaging solution when the absorbent member transitions from the compressed state toward the expanded state.

8. The contact lens package of claim 1, wherein the absorbent member is configured for absorbing at least a portion of the packaging solution when the package is transitioned from the unopened state to an opened state.

9. The contact lens package of claim 1, wherein the absorbent member is configured for absorbing a majority of the packaging solution when the package is transitioned from the unopened state to an opened state.

10. The contact lens package of claim 1, wherein the absorbent member is biased toward the expanded state.

11. The contact lens package of claim 1, wherein the absorbent member is disposed adjacent the contact lens.

12. The contact lens package of claim 1, wherein the absorbent member comprises a sponge.

13. The contact lens package of claim 1, wherein the lid is sealed to the base along at least a portion of a perimeter of the cavity when the package is in the unopened state, and wherein the seal between the lid and the base is at least partially broken when the package is in an opened state.

14. The contact lens package of claim 13, wherein the lid is sealed to the base along an entirety of the perimeter of the cavity.

15. The contact lens package of claim 1, wherein the lid extends over and covers the contact lens when the package is in the unopened state, and wherein the lid does not cover the contact lens when the package is in an opened state.

16. The contact lens package of claim 1, wherein the lid extends over and covers the absorbent member when the package is in the unopened state, and wherein the lid does not cover the absorbent member when the package is in an opened state.

17. The contact lens package of claim 1, wherein the lid extends over and covers the absorbent member when the package is in the unopened state, and wherein the lid extends at least partially over the absorbent member when the package is in an opened state.

18. The contact lens package of claim 1, wherein the contact lens is disposed within the cavity such that a convex surface of the contact lens faces the lid when the package is in the unopened state.

19. The contact lens package of claim 1, wherein the contact lens is disposed within the cavity such that a convex surface of the contact lens is exposed and accessible to a user when the package is in an opened state.

20. The contact lens package of claim 1, wherein the contact lens is disposed within the cavity such that a concave surface of the contact lens faces the base when the package is in the unopened state.

21. The contact lens package of claim 1, wherein the absorbent member is connected to the base.

22. The contact lens package of claim 1, wherein the absorbent member is connected to the lid.

23. The contact lens package of claim 1, wherein the lens support comprises a lens facing surface having a convex shape, and wherein the lens facing surface of the lens support engages a concave surface of the contact lens.

24. The contact lens package of claim 1, wherein the lens support comprises a lens facing surface having a convex shape, and wherein the lens facing surface of the lens support defines a portion of the cavity.

25. The contact lens package of claim 1, wherein the lens support comprises a lens facing surface having a convex shape, and wherein the lens support further comprises an external surface disposed opposite the lens facing surface of the lens support and having a concave shape.

26. The contact lens package of claim 25, wherein the concave shape of the external surface of the lens support is configured for receiving a convex portion of an adjacent package therein, thereby facilitating stacking of a plurality of the packages in a nested manner.

27. The contact lens package of claim 1, wherein the lid extends over and covers the lens support when the package is in the unopened state, and wherein the lid does not cover the lens support when the package is in an opened state.

28. The contact lens package of claim 1, wherein the base further comprises an absorbent-member support that supports the absorbent member within the cavity.

29. The contact lens package of claim 1, wherein the absorbent-member support comprises an internal surface having a planar shape.

30. The contact lens package of claim 29, wherein the internal surface of the absorbent-member support defines a portion of the cavity.

31. The contact lens package of claim 29, wherein the absorbent-member support further comprises an external surface disposed opposite the internal surface of the absorbent- member support and having a planar shape.

32. The contact lens package of claim 29, wherein the absorbent member is connected to the absorbent-member support.

33. The contact lens package of claim 29, wherein the lid extends over and covers the absorbent-member support when the package is in the unopened state, and wherein the lid does not cover the absorbent-member support when the package is in an opened state.

34. The contact lens package of claim 29, wherein the lid extends over and covers the absorbent-member support when the package is in the unopened state, and wherein the lid extends at least partially over the absorbent-member support when the package is in an opened state.

35. The contact lens package of claim 29, wherein the lens support extends above the absorbent-member support and is configured for facilitating drainage of the packaging solution toward the absorbent member when the package is in an opened state.

36. The contact lens package of claim 10, wherein the base is rigid and the lid is flexible.

37. The contact lens package of claim 10, wherein the base is flexible and the lid is flexible.

38. The contact lens package of claim 10, wherein the lid comprises a foil layer.

* * * * *